US007172641B2

(12) United States Patent
Cook et al.

(10) Patent No.: US 7,172,641 B2
(45) Date of Patent: Feb. 6, 2007

(54) ULTRA-HARD BORIDE-BASED METAL MATRIX REINFORCEMENT

(75) Inventors: Bruce Allan Cook, Ankeny, IA (US); Alan Mark Russell, Ames, IA (US); Joel Lee Harringa, Ames, IA (US); S. Bulent Biner, Clive, IA (US); Iver Anderson, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 81 days.

(21) Appl. No.: 10/871,933

(22) Filed: Jun. 18, 2004

(65) Prior Publication Data

US 2005/0279185 A1 Dec. 22, 2005

(51) Int. Cl.
*C22C 49/06* (2006.01)

(52) U.S. Cl. ..... 75/244; 75/249

(58) Field of Classification Search ..... 75/244, 75/245, 249

See application file for complete search history.

(56) References Cited

U.S. PATENT DOCUMENTS 3,940,276 A * 2/1976 Wilson ..... 501/120
5,162,478 A 11/1992 Barton et al.
5,547,107 A 8/1996 Boiardi
6,099,605 A * 8/2000 Cook et al. ..... 51/307
6,406,516 B1 * 6/2002 Song et al. ..... 75/684
6,921,422 B2 * 7/2005 Cook et al. ..... 51/307

FOREIGN PATENT DOCUMENTS

CN 1487109 * 4/2003
JP 2004076111 3/2004

OTHER PUBLICATIONS

KiON CERASET®, "Ceramic Precursor Applications" http://kioncorp.com/bulletins/docs/ceramic.pdf.

* cited by examiner

*Primary Examiner*—Ngoclan T. Mai
(74) *Attorney, Agent, or Firm*—McKee, Voorhees & Sease, P.L.C.

(57) ABSTRACT

A composite of M/$AlMgB_{14}$ or M alloy/$AlMgB_{14}$ is synthesized, where M=Al, Ti, W, or Cu. Small particles and/or fibers of $AlMgB_{14}$ are distributed throughout a metal matrix to strengthen the resulting composite.

4 Claims, 3 Drawing Sheets

ULTRA-HARD BORIDE-BASED METAL MATRIX REINFORCEMENT

GRANT REFERENCE

This research was federally funded under DOE Contract No. DOE-EE ED 19/2803/AMES and DOE Contract No. W-7405-ENG-82. The government may have certain rights in this invention.

FIELD OF THE INVENTION

The field of the invention involves an ultra-hard boride-based reinforcement, $AlMgB_{14}$, for metals and metal alloys.

BACKGROUND OF THE INVENTION

This invention partially relates to an advancement on our prior patents, U.S. Pat. No. 6,099,605 and its division, U.S. Pat. No. 6,432,855; the first issued Aug. 8, 2000 and the second Aug. 13, 2002. Those patents relate to a ceramic material which is an orthorhombic boride of the general formula: $AlMgB_{14}$. Crystallographic studies indicate that the metal sites are not fully occupied in the lattice so that the true chemical formula may be closer to $Al_{0.75}Mg_{0.78}B_{14}$ which is contemplated by the formula here used as $AlMgB_{14}$. The ceramic is a superabrasive, and in most instances provides a hardness of 30 GPa or greater. This invention relates to an improvement involving the use of $AlMgB_{14}$ and related compositions as a strengthening reinforcement in metals, particularly Al and Al alloys.

Particulate and fiber reinforced metals have been known for decades and commercially available for at least a decade. The composites reinforce the metal matrix while still maintaining favorable metalworking characteristics and metal-like properties.

The primary objective of this improvement invention is to provide a new, strong metal composite, with the particular and preferred case of aluminum and its alloys here cited as a prime example. However, use of $AlMgB_{14}$ as a reinforcement is not limited to Al and Al alloys, but can be used with other metals (M). For example, the boride is also expected to provide a similar reinforcement effect in alloys of titanium, tungsten, and copper.

SUMMARY OF THE INVENTION

A composite of M/$AlMgB_{14}$ or M alloy/$AlMgB_{14}$ is synthesized, where M represents a metal such as Al, Ti, Cu, or W. Small particles or fibers of $AlMgB_{14}$ are distributed throughout the metal matrix to strengthen the resulting composite and may be used at levels up to 50% by volume.

DETAILED DESCRIPTION OF A PREFERRED EMBODIMENT

Figure 1:
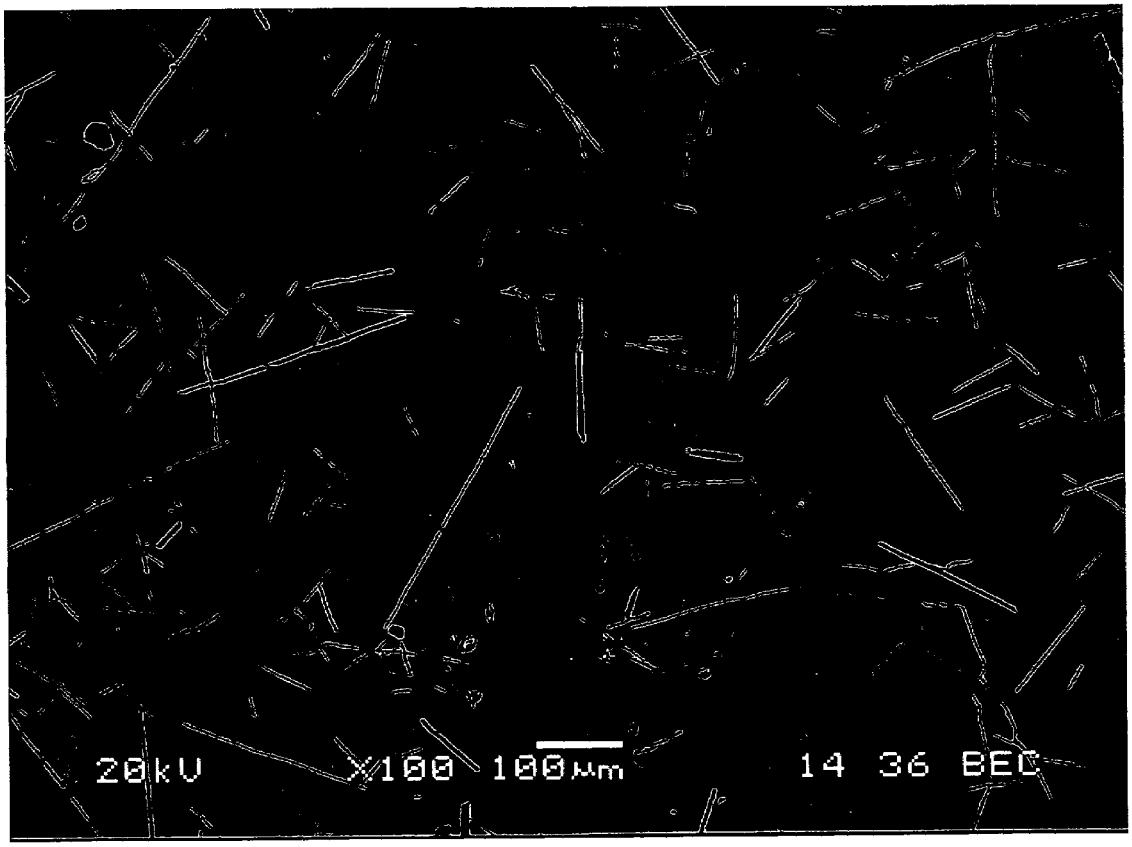
FIG. 1 is a scanning electron microscope view of an Al/$AlMgB_{14}$ composite grown from the melt and provides an example of a particulate reinforcement.

Small particles or fibers of $AlMgB_{14}$ are distributed throughout metal or metal alloy matrix, such as Al, Ti, W, or Cu to strengthen the resulting composite and offer improved high-temperature stability relative to existing discontinuously-reinforced structures based on additions of SiC, $Al_2O_3$, BN, $B_4C$, TiC or $TiB_2$. The additives in discontinuously-reinforced metal matrix composites (MMC) are added at levels below the percolation threshold; that is, no network of additives is formed. If too much reinforcement is added to the metal matrix, the resulting composite material becomes brittle. Generally the amount should be from 5% to 30% on a volume basis.

As a majority of the prior art has focused on aluminum and aluminum alloys, the following discussion will employ this class or MMCs as the primary illustration of the concept. SiC reinforcement is reported to react with Al at elevated temperature, which degrades the matrix reinforcement interface. Wettability of SiC with Al is not good. Also, the 3.23 g/cc density is somewhat higher than ideal. BN reinforcements exhibit low strength and low ductility. The density of $TiB_2$ is 4.5 g/cc, which is twice that of aluminum, leading to segregation problems in the melt. $B_4C$ (2.51 g/cc) has about the right density to match molten aluminum, but cannot be grown out of solution and is not amenable to solution processing. When $B_4C$ is ground oxides form that subsequently degrade the Al-reinforcement interface. $Al_2O_3$ has a density of 3.97 g/cc which is too high to form a homogenous mixture with molten aluminum or molten aluminum alloy. $TiC_2$ has a density of 4.93 g/cc which is also too high to form a homogeneous mixture with molten aluminum or molten aluminum alloy. $AlMgB_{14}$ particulates and fibers possess improved wettability with Al, leading to better load transfer from the matrix, and improved high temperature stability.

At room temperature, the density of $AlMgB_{14}$ is 2.67 g/cc, nearly identical to that of Al (2.70 g/cc). At temperatures above the melting point of Al (660° C.), the densities differ by only 12% as the density of Al decreases to 2.35 g/cc. These nearly equal densities make segregation problems (i.e. floating or sinking particles and/or fibers) in the melt, inherent with other additives, of minimal concern for Al/$AlMgB_{14}$.

The rapid stirring of the melt necessary to avoid segregation in most MMCs can entrain nascent oxide films and gaseous species (particularly hydrogen) into the melt, degrading properties of the composite. However, with an Al/$AlMgB_{14}$ composite, only slow or minimal stirring is needed to maintain a uniform distribution of particles or fibers, which greatly reduces the problems with oxides and gas pick-up. Thus, the resulting distribution of $AlMgB_{14}$ reinforcement is highly uniform throughout the ingot. Moreover, $AlMgB_{14}$ reinforcement can be introduced in-situ by a solution-growth technique, in which the desired hard phase nucleates out of the Al melt. By proper control of the cooling rate to obtain a high nucleation rate combined with a slow growth rate, ultra-fine (nanophase) boride reinforcement particles or fibers form throughout the matrix, resulting in enhanced strengthening. Since the $AlMgB_{14}$ crystals nucleate directly from an aluminum flux, the surface energy between the particle and matrix should be low, resulting in highly efficient load transfer to the hard phase. An important part of this invention is the melt processing. There is no oxide interface between aluminum and $AlMgB_{14}$. Therefore, the strength of the interface is maximized. Any $Al_2O_3$ is taken off as slag.

Figure 2:
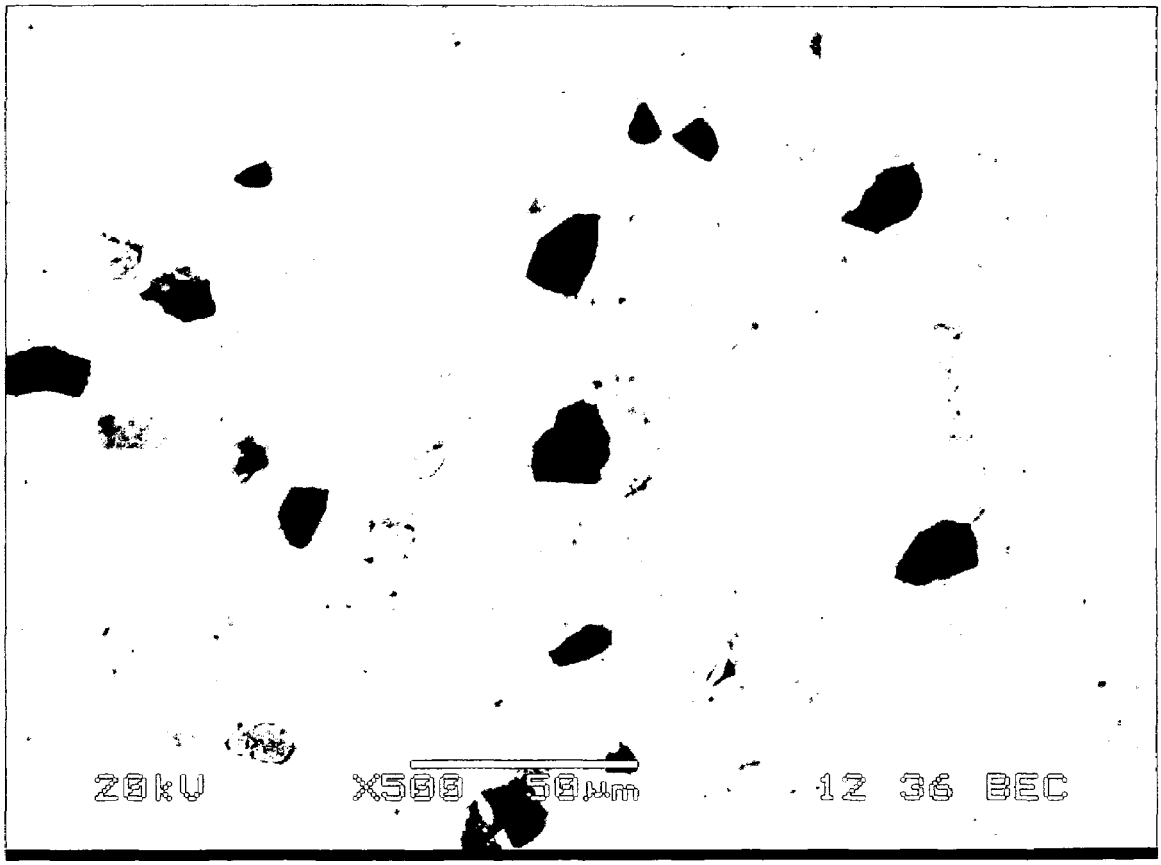
FIG. 2 shows a typical fiber reinforcement morphology. Both manifestations of FIGS. 1 and 2 are possible depending on the cooling rate.
Figure 3:
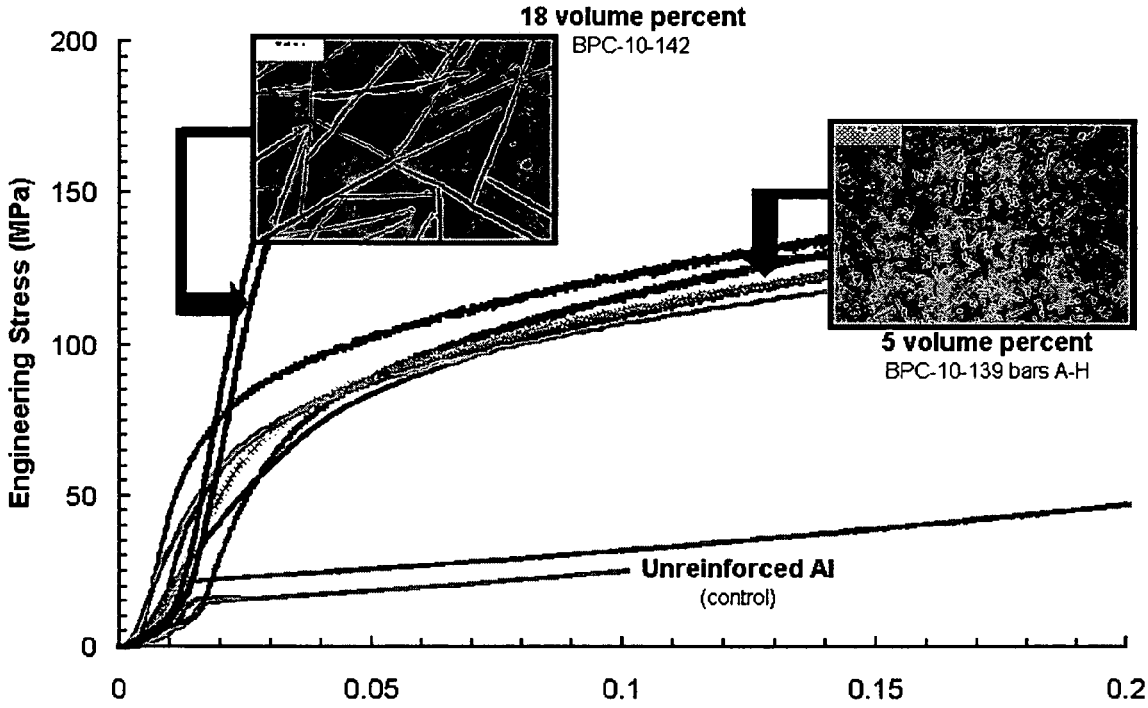
FIG. 3 is a stress-strain curve for Al and the Al/$AlMgB_{14}$ composite.

Heat treatment studies indicate that the $AlMgB_{14}$ particles in an Al matrix are stable and do not react with the matrix, thereby preserving the integrity of the interface. The reinforced aluminum composite possessing the microstructure shown in FIG. 2 was heat treated in air at 400° C. (752° F.), a temperature equal to 72% of the absolute melting point of aluminum, for 96 hours. Following the heat treatment, the resulting microstructure was examined and found to be indistinguishable from that of the as-cast material, with no observable coarsening or redistribution of the boride reinforcement phase. As a result, an $AlMgB_{14}$ reinforced aluminum alloy may be used at higher temperatures than existing composites, which is of considerable interest to the aerospace community.

There are at least four methods of making Al/$AlMgB_{14}$ composites detailed in Examples 1–4. The following examples are offered to illustrate but not limit the invention.

EXAMPLE 1

Synthesis of Al/$AlMgB_{14}$ Composite In Situ

The following is a prophetic example. 1672.76 g (62 mol; 91.6 wt. %) Al is melted above the melting temperature of Al (660° C.). 129.72 g (12 mol; 7.1 wt. %) B and 24.31 g (1 mol; 1.3 wt. %) Mg are added. Natural convection in the liquid disperses the B and Mg; typically 5 to 60 minutes is sufficient time for dispersion. The composite is cooled; crystals and fibers form of $AlMgB_{14}$ within the metal matrix. Part of the reason this example works is that the surface energy of $AlMgB_{14}$ is nearly the same as the surface energy of Al. This method is a preferred method to the extent that finer reinforcement particles and fibers are produced.

EXAMPLE 2

Synthesis of Al/$AlMgB_{14}$ Composite

The following is a prophetic example. 100 g Al is melted above 660° C. and below about 1500° C. Enough $AlMgB_{14}$ is added to comprise about 5 vol. % to about 30 vol. % of the total solution, and the liquid is slowly stirred to distribute the $AlMgB_{14}$ particles throughout the liquid metal. The $AlMgB_{14}$ is not melted (m.p. ≈2100° C.), nor is it formed in situ. Instead, $AlMgB_{14}$ is simply added to the Al solution and the solution is cooled.

EXAMPLE 3

Synthesis of Al/$AlMgB_{14}$ Composite by Cold Pressing

The following is a prophetic example. 100 cc Al powder is added to 5 cc to 30 cc $AlMgB_{14}$ powder. The density of $AlMgB_{14}$ is 2.67 g/cc. The particle size of the Al is from 10 nm to 100 μm. The particle size of the $AlMgB_{14}$ is from 10 nm to 100 μm. The smaller the particle, the stronger is the reinforcement. However, smaller particles aggregate. In any case, particles less than 10 μm are preferred. The powders are mixed and transferred into an appropriate mold. Hydraulic force is used to compress the particulates together. Alternatively, cold isostatic pressing may be used; high fluid pressure is applied to a powder part at ambient temperature to compact it into a predetermined shape. The pressure in a cold isostatic press chamber may reach 100,000 psi. Water or oil is usually used for the pressure medium. The product is a dense preformed metal composite which may be subsequently sintered to improve strength and reduce porosity.

EXAMPLE 4

Synthesis of Al/$AlMgB_{14}$ Composite by Hot Pressing

The following is a prophetic example. This example is the same as Example 3 except that a sample is heated when densified. Hot isostatic presses involve a heated argon atmosphere or other gas mixtures and pressures up to 100,000 psi. The product is a dense preformed metal composite. The disadvantage of hot pressing is that the metal, grains tend to grow during hot pressing. It is better to preserve small grain sizes.

EXAMPLE 5

Synthesis of Al/$AlMGB_{14}$ Composite in Situ

The following is a prophetic example. 1672.76 g* of standard Al alloy 5050 (Aluminum Association numbering system) (98.6 wt. % Al, 1.4 wt. % Mg) is melted above the melting temperature (~650° C.). 127.89 g (12 mol; 7.1 wt. %) B are added. Natural convection in the liquid disperses the B; typically 5 to 60 minutes is sufficient time for dispersion. The composite is cooled; crystals and fibers form $AlMgB_{14}$ within the Al matrix. Part of the reason this example works is that the surface energy of $AlMgB_{14}$ is nearly the same as the surface energy of Al. This method is a preferred method to the extent that finer reinforcement particles and fibers are produced. It has an advantage over Example 1 in that volatile Mg metal is already present in this alloy and thus Mg need not be added.

From the above previous description and examples it can be seen that the invention, at least accomplishes the stated objectives.

What is claimed is:

1. A reinforced alloy comprising metal or a metal alloy with from 5% vol. % to about 30% vol. % of $AlMgB_{14}$ in the form of particles and/or fibers to reinforce said alloy.

2. The reinforced alloy of claim 1 wherein the metal is Al or an Al alloy an the Al alloy comprises from 90 wt. % to 100 wt. Al; from 0 wt. % to 7.0 wt. % Cu; from 0 wt. % to 1 wt. % Bi; from 0 wt. % to 1 wt. Pb; from 0 wt. % to 2 wt. % Fe; from 0 wt. % to 6 wt. % Mg; from 0 wt. % to 2 wt. Mn; from 0 wt. % to 14 wt. % Si; and from 0 wt. % to 8 wt. % Zn.

3. The reinforced Al alloy of claim 2 wherein the Al alloy is from 80 wt. % Al to 100 wt. % Al; and the solid density of said reinforced alloy is from 2.50 g/cc to 2.90 g/cc.

4. The reinforced Al alloy of claim 3 wherein the solid density of said reinforced alloy is from 2.60 g/cc to 2.80 g/cc.

* * * * *